US009045893B2

(12) United States Patent
Ahmed

(10) Patent No.: US 9,045,893 B2
(45) Date of Patent: Jun. 2, 2015

(54) CUT STONE CONSTRUCTION AND MASONRY METHOD

(71) Applicant: UMM AL-QURA UNIVERSITY, Makkah (SA)

(72) Inventor: Khaled I. Nabil Ahmed, Makkah (SA)

(73) Assignee: UMM AL-QURA UNIVERSITY, Makkah (SA)

( * ) Notice: Subject to any disclaimer, the term of this patent is extended or adjusted under 35 U.S.C. 154(b) by 0 days.

(21) Appl. No.: 13/784,766

(22) Filed: Mar. 4, 2013

(65) Prior Publication Data

US 2014/0245679 A1 Sep. 4, 2014

(51) Int. Cl.
*E04B 2/40* (2006.01)
*E04B 2/04* (2006.01)

(52) U.S. Cl.
CPC ..... *E04B 2/04* (2013.01)

(58) Field of Classification Search
CPC ..... E04B 1/04; E04B 1/34315; E04B 2001/2463; E04B 2002/0269; E02D 27/02; E02D 29/025; E04C 2/243; E04C 2/246; E04C 1/40
USPC ..... 52/56.1, 293.1, 293.2, 311.2, 568, 574, 52/578, 592.5, 592.6, 596
See application file for complete search history.

(56) References Cited

U.S. PATENT DOCUMENTS

| | | | | | |
|---|---|---|---|---|---|
| 868,999 | A * | 10/1907 | Lease | 52/503 |
| 1,428,470 | A * | 9/1922 | Brainerd | 52/605 |
| 1,768,651 | A * | 7/1930 | Wyatt | 52/351 |
| 2,185,497 | A * | 1/1940 | Cilento et al. | 52/98 |
| 3,416,276 | A * | 12/1968 | Caputo et al. | 52/436 |
| 3,839,519 | A | 10/1974 | Weiner | |
| 4,703,599 | A * | 11/1987 | Pardo | 52/293.2 |
| 6,503,319 | B1 | 1/2003 | Courage et al. | |
| 7,168,218 | B2 * | 1/2007 | Spratlen et al. | 52/604 |
| 7,645,098 | B1 * | 1/2010 | Rainey | 405/284 |
| 2007/0113510 | A1 * | 5/2007 | Evereff | 52/592.6 |
| 2007/0266656 | A1 | 11/2007 | Blocken | |
| 2008/0060300 | A1 | 3/2008 | Westmoreland et al. | |
| 2011/0265418 | A1 * | 11/2011 | Wolter et al. | 52/561 |
| 2012/0057939 | A1 * | 3/2012 | Bone | 405/284 |

* cited by examiner

*Primary Examiner* — Brian Glessner
*Assistant Examiner* — Adam Barlow
(74) *Attorney, Agent, or Firm* — Richard C Litman

(57) ABSTRACT

The cut stone construction and masonry method is a wall construction technique using the Flemish bond pattern and utilizing natural stone cut in blocks. The technique employs only vertically oriented semi-dry mortar layers between the stones. No horizontal mortar layers are used in the construction, except at the foundation level. Use is made of the dry-stacking, horizontal surface bonding techniques developed by the ancient Egyptians.

3 Claims, 2 Drawing Sheets

CUT STONE CONSTRUCTION AND MASONRY METHOD

BACKGROUND OF THE INVENTION

1. Field of the Invention

The present invention relates to building construction, and particularly to a cut stone construction and masonry method using natural stone and semi-dry mortar.

2. Description of the Related Art

Natural stone has been used since ancient times as an effective material for building both large and small structures. The Egyptian and Mayan people are recognized as being masters in the utilization of natural stone blocks for building large, durable structures that have lasted for centuries. Natural stone is an environmentally friendly, relatively low-cost building material that is socially accepted in many parts of the world. Conventionally, the stone is cut at the quarry into rectangular blocks of varied, predetermined dimensions. The blocks are assembled in a pattern to form the walls of the structure to be built. The Flemish Bond pattern is a popular pattern in areas where stone and bricks are still used. In Flemish bond construction, a course that alternates stretcher blocks and header blocks is laid. A second course is laid on top of the first course with the headers of the first course being centered under the stretchers of the second course. Additional courses continue this pattern. Mortar is applied at the horizontal and vertical junctures of the blocks to bind the blocks to each other. Even though the stone is relatively inexpensive, this method of construction is time-consuming, requires a large amount of mortar, and entails mortar joint treatment after completion. The building industry would welcome a simpler and cost efficient alternative to construct walls using natural stone blocks. Thus, a cut stone construction and masonry method solving the aforementioned problems is desired.

SUMMARY OF THE INVENTION

The cut stone construction and masonry method is drawn to a wall construction technique using the Flemish bond pattern and utilizing natural stone cut in blocks. The technique employs only vertically oriented, semi-dry mortar layers between the stones. The semi-dry mortar is composed of hydraulic lime, sand and lightweight polymeric grains in equal proportions. No horizontal mortar layers are used in the instant construction, except at the foundation level. Use is made of the dry-stacking, horizontal surface bonding techniques developed by the ancient Egyptians.

Accordingly, the invention presents a natural stone wall construction technique and masonry procedure that employs only vertically oriented mortar layers. The technique and procedure are appropriate for wall construction having a width ranging between twenty-five to fifty centimeters and from two to five stories. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
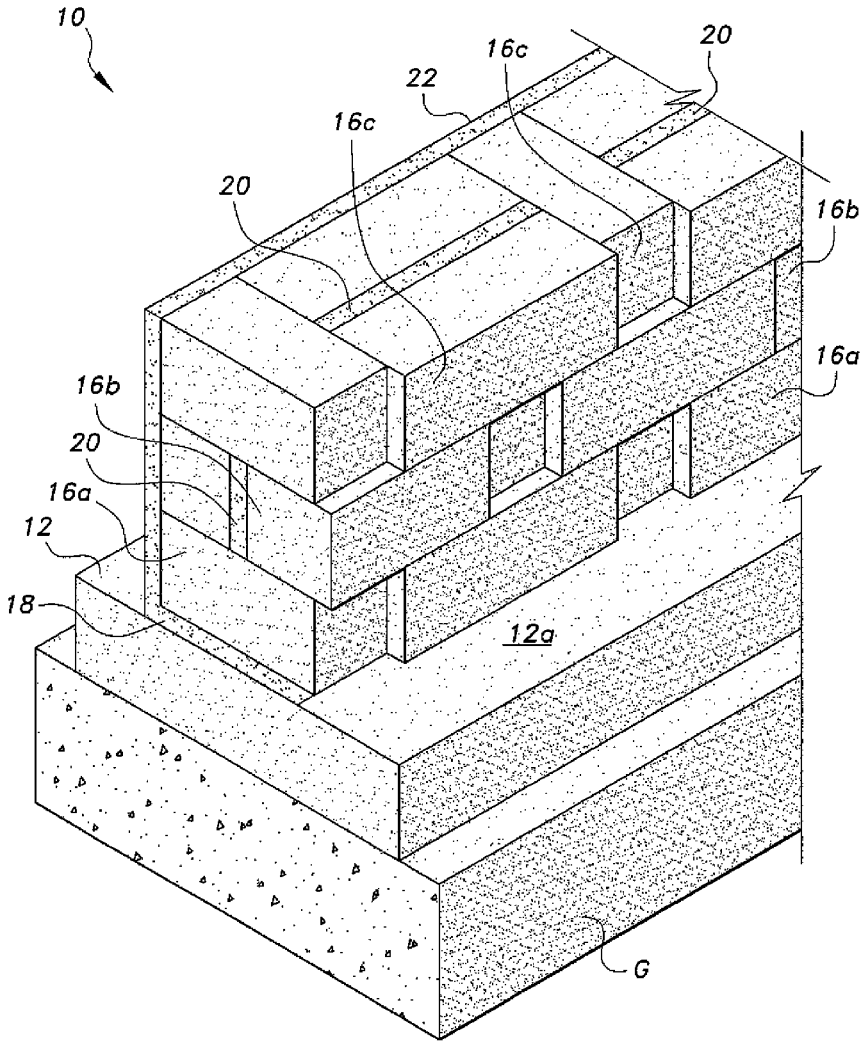
FIG. 1 is a partial perspective view of wall construction using a cut stone construction and masonry method according to the present invention.
Figure 2:
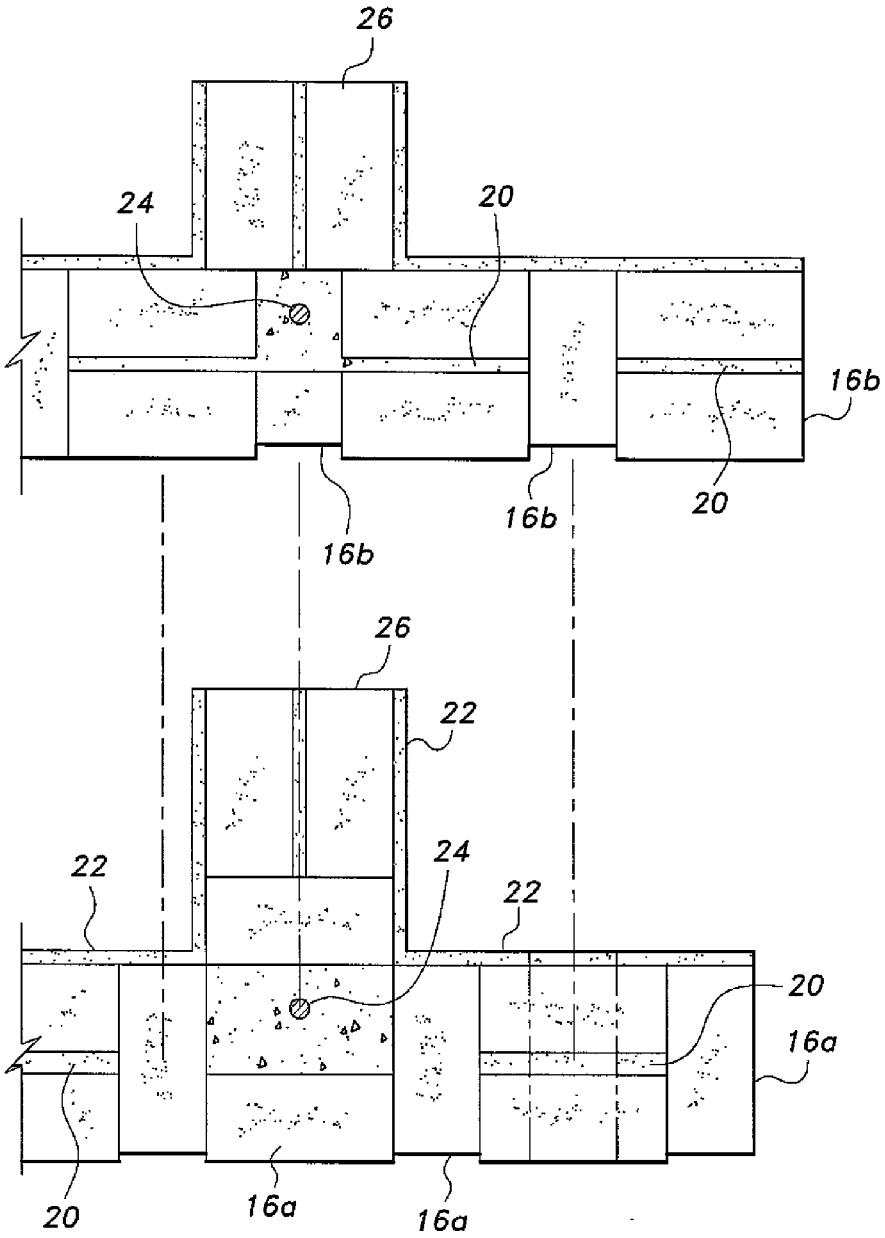
FIG. 2 shows partial top views of the first course and the second course of a wall constructed using a cut stone construction and masonry method according to the present invention, showing the relationship of corresponding portions of the first and second courses.

Referring to FIGS. 1 and 2, the cut stone construction and masonry method is used to form a wall, generally indicated at 10, from natural stone. The wall 10 comprises a foundation member 12 positioned on a flat surface G, such as the ground. The foundation member 12 may take the form of a slab of natural stone or the like having a planar upper surface 12*a*. The wall 10, comprising natural stone blocks, is mounted on the foundation member 12. The wall 10 is of the Flemish bond design, having alternating header (the narrow end of the block transverse to the wall) and stretcher (the longer side of the block extending in the direction of the wall) blocks, the header of one course being centered on the stretcher blocks above and below. The stretcher blocks protrude from the outside to shade the header blocks. FIG. 1 shows three courses of blocks 16*a*, 16*b*, 16*c* mounted on the foundation member 12. A single horizontal layer of mortar 18 is utilized to bond the first course of blocks 16*a* to the foundation member 12. No other horizontal mortar joints are employed. The remaining blocks are dry-stacked in a method of construction employed by the Egyptians many centuries ago, as mentioned above. Only vertically oriented mortar joints 20 are used to bond the blocks. The mortar 20 is semi-dry, and comprises equal proportions of hydraulic lime (a slaked lime used to make lime water that can be set in the absence of air, e.g., underwater), sand and lightweight polymeric grains. Cement plaster 22 reinforced with fibers is applied to the inside surface of the wall to aid the wall in resisting lateral forces and providing monolithic action for the wall. Reinforcing steel rods 24 are inserted through the blocks at junctures that support a dividing inner wall 26.

It is to be understood that the present invention is not limited to the embodiments described above, but encompasses any and all embodiments within the scope of the following claims.

I claim:

1. A natural stone wall, consisting of:

a foundation member having a flat, planar upper surface;

a plurality of pre-cut natural stone blocks positioned on the flat, planar upper surface of the foundation member and forming the only horizontal mortar joint, the stone blocks being dry-stacked in a plurality of courses to form a wall, the courses having only vertically oriented spaces formed between each of the stone blocks, and the dry-stacked courses being coplanar on an interior side of the wall;

wherein the plurality of courses including alternating stretcher blocks and header blocks, the header blocks being centered on the stretcher blocks of the courses immediately above and below the header, the stretcher blocks extending outward beyond the header blocks in order to shade the header blocks;

wherein the wall has an inside surface, the inside surface having a cement plaster coating, the plaster being reinforced with fibers;

wherein selected portions of the wall have steel reinforcing rods;

wherein the plurality of courses are arranged in a Flemish bond design; and a semi-dry mortar disposed in the vertically-oriented spaces only to bond the stone blocks together;

the semi-dry mortar includes a mixture of hydraulic lime, sand, and lightweight polymeric grains; the hydraulic lime, sand and lightweight polymeric grains are mixed in equal proportions.

2. A natural stone wall, consisting of:

a foundation member having a flat, planar upper surface;

a plurality of pre-cut natural stone blocks positioned on the flat, planar upper surface of the foundation member and forming the only horizontal mortar joint, the stone blocks being dry-stacked in a plurality of courses having a Flemish bond design to form a wall, the courses having only vertically oriented spaces formed between each of the stone blocks;

wherein the wall has an inside surface, the inside surface having a cement plaster coating, the plaster being reinforced with fibers;

wherein selected portions of the wall have steel reinforcing rods;

wherein the plurality of courses having the Flemish bond designed and configured as alternating first blocks and second blocks, the first blocks having a first length dimension greater than a first width dimension, the second blocks having a second length dimension less than a second width dimension, the second blocks being centered on the first blocks about the first width dimension of the courses immediately above and below the second blocks, the first blocks extending outward beyond the second blocks in order to shade the second blocks; and a semi-dry mortar disposed in the vertically oriented spaces to bond the stone blocks together, the semi-dry mortar being hydraulic lime, sand, and lightweight polymeric grains mixed in equal proportions.

3. A method of constructing a wall of natural stone, consisting of the steps of:

providing a foundation member having a flat, planar upper surface;

laying a horizontal layer of mortar on the foundation member;

positioning a plurality of pre-cut natural stone blocks on the horizontal layer of mortar, the blocks being dry-stacked in a plurality of courses arranged in a Flemish bond design, the courses having only vertically oriented spaces between each of the blocks;

inserting a semi-dry mortar into the vertically oriented spaces only to bond the blocks together;

wherein the semi-dry mortar is a mixture of hydraulic lime, sand, and lightweight polymeric grains mixed in equal proportions; and coating the inner surface with a fiber-reinforced cement plaster.

* * * * *